United States Patent [19]

Phipps

[11] Patent Number: 4,628,791

[45] Date of Patent: Dec. 16, 1986

[54] UMBRELLA MUSIC BOX ACCESSORY

[76] Inventor: Henri L. Phipps, Phipps Enterprises, 53 W. Fordham Rd., Bronx, N.Y. 10468

[21] Appl. No.: 774,157

[22] Filed: Sep. 9, 1985

[51] Int. Cl.[4] ..... G10F 1/06; A45B 3/00

[52] U.S. Cl. ..... 84/94 C; 135/16

[58] Field of Search ..... 84/94 R, 94 C, 95 C; 135/16, DIG. 10

[56] References Cited

U.S. PATENT DOCUMENTS

| | | | |
|---|---|---|---|
| 2,087,537 | 7/1937 | Finkel | 135/DIG. 10 X |
| 2,619,931 | 12/1952 | Mueller | 84/94 C |
| 3,715,549 | 2/1973 | Kraff | 84/94 C X |
| 3,750,520 | 8/1973 | Inoue | 84/94 C |

*Primary Examiner*—William B. Perkey

*Attorney, Agent, or Firm*—Richard L. Miller

[57] ABSTRACT

This invention is a music box and a special clamp for securing the box on an umbrella shaft at a location where a canopy-spreading mechanism of the umbrella automatically activates the music box when the umbrella is opened up.

4 Claims, 4 Drawing Figures

UMBRELLA MUSIC BOX ACCESSORY

BACKGROUND OF THE INVENTION

This invention relates generally to folding umbrellas such as are commonly used for personal protection from rain. More specifically it relates to umbrella accessories.

It is well known that a conventional umbrella offers only the utilitarian purpose of rain protection and nothing more. It is used particularly on days when the weather is dreary and a user's spirits may accordingly be more low than usual, and at which time a person could use something that might uplift his feelings so as to get his thoughts off the falling rain.

SUMMARY OF THE INVENTION

Therefore it is a principal object of the present invention to provide an umbrella accessory that plays a musical melody when the umbrella is in use so as to also give some pleasure to the user.

Another object is to provide an umbrella accessory comprising a music box which can be quickly and easily attached to any umbrella and which automatically operates when the umbrella is opened up.

Other objects are to provide an umbrella music box accessory rugged in construction, inexpensive to purchase and that is efficient in operation.

Further objects of the invention will appear as the description proceeds.

Still a further object is to provide an umbrella accessory comprising a music box which is particular well suited to encourage children and particularly little girls to carry an umbrella during inclement weather.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENTS

Figure 1:
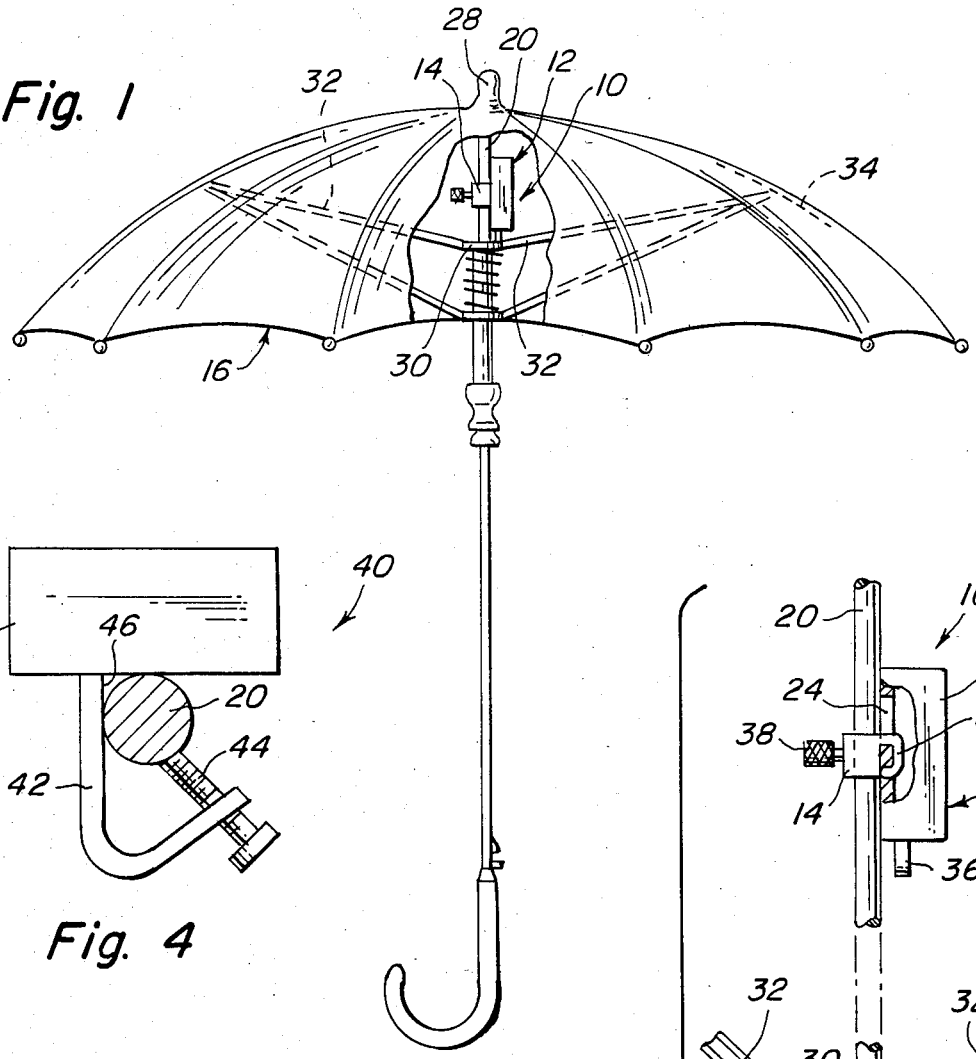
FIG. 1 is a side elevational view with parts broken away of an umbrella with the invention installed thereon
Figure 2:
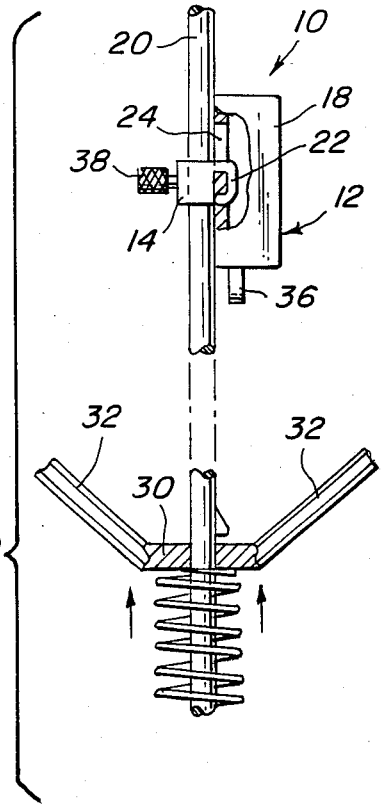
FIG. 2 is an enlarged side elevational view of a portion of the umbrella with parts broken away showing the invention in greater detail.
Figure 3:
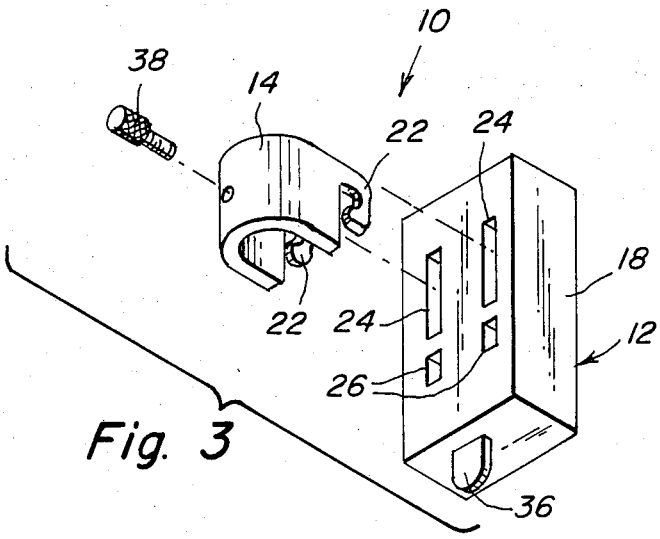
FIG. 3 is an exploded perspective view of the invention.

Referring now to the Drawing in greater detail, and more particularly to FIGS. 1 to 3 thereof, at this time, the reference numeral 10 represents an umbrella music box accessory, according to the present invention, wherein there is a conventional music box 12 and a special clamp 14 for attachment thereof to an umbrella 16.

The music box comprises a case 18 containing a conventional music box mechanism (not shown) and may include a hand-wound device, or an electrical device (also not shown) for playing the music.

The clamp is "U"-shaped for extending around a shaft 20 of the umbrella, and each opposite end of the clamp includes a hook-shaped tongue 22 for being inserted into a slot 24 of the case and then slided so that an end of the tongue snap fits into a hole 26 for rigid securement of the device to the umbrella. The device is installed so as to be located between an apex 28 of the umbrella and a slidable upper ring 30 from which the upper braces 32 extend to hold the canopy-supporting frame 34 in spread open position. A downwardly trigger 36 protrudes out of a bottom of the music box case so as to abut against the ring 30 when the umbrella is opened up, thus freeing the music box motor to operate the mechanism. A set screw 38 locks the clamp along the shaft 20.

When playing, the sound from the music box passes outward through the elongated upper end of the slots 24.

Figure 4:
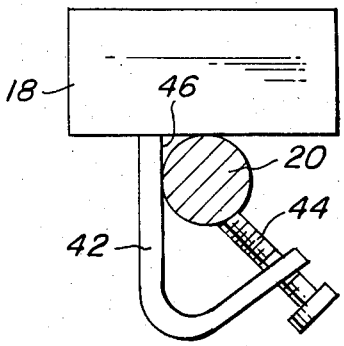
FIG. 4 is a top view of a modified form of the invention showing another type of securement device.

In a modified design of the device 40, shown in FIG. 4, a clamp 42 is substituted for clamp 14. One end of the clamp is affixed to the case 18 and the other end is threaded, receiving a set screw 44 for bearing against the shaft 20 resting in a corner 46 formed between the case 18 and the clamp.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In combination, a folding umbrella and a music box, the umbrella comprising a shaft portion, and upper slidable ring on the shaft portion, braces extending from the ring and supporting a canopy proximate the upper apex of the shaft portion, the music box comprising a special clamp secured to the shaft portion between the apex and the slidable ring, whereby the music box is operable upon sliding of the upper slidable ring.

2. The combination as set forth in claim 1, wherein said music box includes a downward protruding trigger for abutment with said ring to activate said music box.

3. The combination as set forth in claim 2, wherein a set screw on said clamp rigidly affixes said music box along said shaft.

4. The combination as set forth in claim 3, wherein said trigger activates a said music box whereby it plays.

* * * * *